US011767643B2

(12) United States Patent
Waldon

(10) Patent No.: US 11,767,643 B2
(45) Date of Patent: Sep. 26, 2023

(54) VERSATILE LIGHT RAIL BED PAVER

(71) Applicant: Allen Engineering Corporation, Paragould, AR (US)

(72) Inventor: Edward Andrew Waldon, Paragould, AR (US)

(73) Assignee: Allen Engineering Corp., Paragould, AR (US)

( * ) Notice: Subject to any disclaimer, the term of this patent is extended or adjusted under 35 U.S.C. 154(b) by 399 days.

(21) Appl. No.: 17/115,400

(22) Filed: Dec. 8, 2020

(65) Prior Publication Data

US 2021/0172124 A1 Jun. 10, 2021

Related U.S. Application Data

(60) Provisional application No. 62/946,140, filed on Dec. 10, 2019.

(51) Int. Cl.
*E01B 29/00* (2006.01)
*E01B 1/00* (2006.01)

(52) U.S. Cl.
CPC ..... *E01B 29/005* (2013.01); *E01B 1/002* (2013.01); *E01B 2203/00* (2013.01); *E01B 2204/09* (2013.01)

(58) Field of Classification Search
CPC ..... E01B 29/005
See application file for complete search history.

(56) References Cited

U.S. PATENT DOCUMENTS 4,249,327 A 2/1981 Allen
4,314,773 A 2/1982 Allen
4,702,640 A 10/1987 Allen
5,328,295 A 7/1994 Allen
5,352,063 A 10/1994 Allen
5,476,342 A 12/1995 Allen
5,562,361 A 10/1996 Allen
7,950,874 B2 * 5/2011 Guntert, Jr. ..... E01C 19/42 404/105

FOREIGN PATENT DOCUMENTS

EP 1191145 A1 * 3/2002 ..... E01B 1/004

* cited by examiner

*Primary Examiner* — Seyed Masoud Malekzadeh
*Assistant Examiner* — Timothy G Hemingway
(74) *Attorney, Agent, or Firm* — Stephen D. Carver

(57) ABSTRACT

A concrete finishing and forming machine adapted for rail trackbed deck construction accommodates various plinths and channels needed for light rail construction. The adjustably configurable machine comprises a rigid frame disposed above a deck by vertically upright, adjustable jack stands supported at their bottoms by wheeled, powered bogies adapted to traverse upon suitable rails on opposite sides of the deck. The jack-stands may be connected to supporting swing arms that extend from pivot sleeves enabling the jack stands to angularly swing out from the frame. A slidable carriage that is longitudinally displaceable within the frame supports at least one downwardly extending, vertically adjustable paving head having a tool that, when immersed within wet concrete and then horizontally displaced, strikes off elongated, smoothed channels resembling pathways upon the concrete. The heads are longitudinally displaceable relative to the carriage so they may be spaced apart such that plinth strips are concurrently formed between the channels.

18 Claims, 19 Drawing Sheets

VERSATILE LIGHT RAIL BED PAVER

CROSS REFERENCE TO RELATED APPLICATION

This utility conversion application is based upon and claims priority from prior U.S. Provisional Application entitled "Versatile Light Rail Bed Paver," Ser. No. 62/946,140, Filed Dec. 10, 2019, by inventor Edward Andrew Waldon (American Citizen), which is hereby incorporated by reference.

BACKGROUND OF THE INVENTION

I. Field of the Invention

The present invention relates generally to mechanized pavers for compacting and densifying raw or wet concrete when forming supportive decks. More particularly, the present invention relates to concrete pavers for shaping and finishing rail trackbeds characterized by multiple, parallel, plinth strips separated from and/or bordering multiple, parallel, channel floors.

II. Description of the Prior Art

Modern "light-rail" train systems offer numerous well-known transportation advantages and efficiencies to urban environments. Light rail systems provide a form of tramway or urban rail transit, using rolling stock. They operate at a higher capacity than most historical tramways, and are often formed on an exclusive right-of-way in potentially congested commuting areas. In use, either individual tramcars or multiple units are coupled to form a train that is of lower capacity and lower speed than a conventional, heavy-rail passenger train or metro system. A few light rail networks tend to have characteristics closer to rapid transit; some of these heavier, rapid transit-like systems are referred to as "light metros". Other light rail networks are tram-like in nature and partially operate on streets.

Light-rail systems of course include elongated stretches of rails, which are placed over suitable supporting trackbeds constructed along dedicated pathways. A typical trackbed comprises lower layers of ballast and sub-ballast prepared over a subgrade. A properly constructed trackbed can significantly improve the ride quality experienced by passengers. The trackbed's uppermost, exposed outer deck usually comprises concrete, which may be laid down and shaped by concrete finishing and placement machines known in the art. Suitable raised concrete projections, comprising slightly elevated blocks or slabs known as "plinths", can be formed for supporting steel rail tracks and their mounting hardware, which are secured to the trackbed as the construction process progresses.

It is well recognized in the art that wet or plastic concrete must be processed or finished soon after pouring and before significant hardening to achieve desirable characteristics. Wet concrete is normally discharged from above and poured between spaced-apart forms that may border and traverse regions to be paved, such as bridge decks and the like. Usually wet concrete is poured immediately in front of a concrete finishing machine that may be supported by spaced-apart concrete forms that function as supporting guide rails for the machinery. For best results, it preferred to vigorously vibrate green concrete during pouring to facilitate desirable concrete consolidation. A variety of finishing devices such as strike-offs, screeds, vibrating screeds, roller screeds or pavers, and bridge deck pavers are known in the concrete arts. Various propulsion means may be employed for machine displacement over supports for travel along the deck length.

The concrete deck forming the top of the trackbed can be formed, but not without difficulty, with various bridge deck and concrete placement apparatus. The concrete deck may comprise at least a pair of parallel, spaced apart, plinth strips for supporting pedestal-like plinth structures that are subsequently formed atop the concrete structure. Completed plinth's are formed with elevated, box-like support forms that surround rebar stirrups emanating from the previously established plinth pathways. Smoothed channels usually comprising a squarish or rectangular profile are preferably formed between the plinths. These channels may be shaped or interiorly contoured for a variety of reasons, such as supporting drainage scuppers at the reduced elevation centers of one or more of the channel floors. Once the plinths are finished, the bordering channel floors form the bottom of troughs that extend along and adjacent to the plinths.

Plinth strip rebar stirrups provide an attachment means for the subsequently attached rail mounting hardware and the various rails themselves. After the concrete hardens, the various rail supporting hardware items, including fasteners, support plates, dampening layers and the like are fastened atop the plinths and interconnected with rebar prior to installation of the train rails.

Automated concrete finishing and forming machines for quickly and efficiently laying down significant lengths of trackbed concrete, with a proper arrangement of plinth and channel structures, are thus desirable. However, known concrete finishing machines of conventional construction are not particularly adept at the latter function.

Allen Engineering Corporation has previously developed concrete finishing machines that can use rigid, horizontally disposed, support frames, such as box frames or triangular truss frames. These can support various tool arrangements that hang down and contact wet concrete. Allen U.S. Pat. No. 4,249,327, for example, discloses a rigid, elongate triangular truss frame.

Besides well-known screed and strike-off elements, rollers are known. For example, a roller-tube finishing machine is seen in U.S. Pat. No. 4,314,773 issued Feb. 9, 1982 and owned by the present assignee. It discloses a form-riding, concrete placement and finishing machine comprising multiple roller tubes, that is positioned above an area into which wet concrete has been poured, for vibrating the concrete mass and finishing the concrete surface.

U.S. Pat. No. 4,702,640 issued Oct. 27, 1987, and also owned by Allen Engineering Corporation, discloses another rotating-tube type concrete finisher.

U.S. Pat. No. 5,562,361 issued to Allen Engineering Corporation Oct. 8, 1996 discloses a powered, form-riding, concrete finisher that uses a trio of rotating tubes to strike-off, screed and finish concrete.

U.S. Pat. No. 5,352,063, issued to Allen Engineering Corporation on Oct. 4, 1994 discloses a concrete finisher entitled "Polymer Concrete Paving Machine." The latter machine comprises a self-propelled paver that distributes, consolidates, places and finishes polymer concrete to resurface roadbeds. A finishing assembly secured upon a supportive chassis includes a distribution assembly for applying concrete transversely across a surface, and a trailing finishing screed that densifies the concrete. The finishing screed comprises a rigid strike off that initially contacts uncompacted concrete laid by the distribution system. However, none of that machine's accessories or parts are configured or designed to shape rail trackbeds.

While the previously discussed finishers such as roller tube finishers are ideal for certain concrete structures, like bridge decks and floors of "big box" stores, etc., they are impractical for rail trackbed projects because of the alternating plinth's and voids needed in a rail trackbed deck. Numerous other concrete placement machines of diverse forms have been patented by the present assignee, but none are particularly relevant to the construction of concrete rail beds where plinth strips and intermediate channels are required. For example, there are numerous types of strike-offs in use, such as the designs seen in U.S. Pat. No. 5,476,342, owned by the same assignee as in this case.

However, applicant is unaware of any concrete forming machine designed for the specific application of treating and forming concrete trackbed decks, with their plinths and parallel channels. Providing concrete finishing apparatus especially configured for dealing with alternating plinth's and channels needed in a rail trackbed deck is the goal of this invention.

SUMMARY OF THE INVENTION

A concrete finishing and forming machine adapted especially for rail trackbed deck construction, accommodates the subsequent completion of various plinths and channels needed for light rail construction.

The highly versatile and adjustable machine is quickly adaptable to a wide variety of deck configurations and sizes, and may be adjusted at the job site to accommodate varying trackbed paths, inclinations, and angular pathways. The machine preferably comprises an elongated, horizontally extending box or truss frame disposed above the deck by preferably four, vertically upright, adjustable jack stands. In one configuration a jack stand is positioned at each machine corner. The jack stands are supported at their bottoms by wheeled bogies. Preferably the bogies rest upon suitable supports, such as travel rails, provided at opposite sides of the intended deck location prior to concrete treatment. Gross frame and machine displacements along the deck pathway are enabled by the hydraulically powered bogies so the machine can move over and along the trackbed as concrete is configured.

The jack-stands enable frame support vertically above the lower concrete workpiece at a user-selected height. The upper portions of the jack-stands are rigidly connected to supporting swing arms that extend from a rigid, vertically disposed pivot sleeve, that enables the jack stands to assume varying positions angularly swung out relative to the frame. The pivot sleeves are mounted to sleeve brackets that include rollers engaging tracks on the frame, enabling gross adjustments to the frame position by sliding the frame through desired displacements into a correct spacing relative to the jack-stands and thus the lower deck (i.e., the deck segments).

Preferably the frame supports an internally fitted, slidable carriage that can be displaced longitudinally relative to the frame. Carriage wheels engage frame tracks for displacement relative to the frame, enabling precise position adjustments. The carriage supports at least one downwardly extending, longitudinally displaceable paving head that, when immersed within wet concrete below and horizontally drawn along as the machine moves over its supports, strikes off elongated, smoothed channels resembling pathways upon the concrete. Elongated, spaced apart, unfinished plinth strips are concurrently formed between the smoothed channels. Preferably the paving heads are slidable relative to the carriage, and suspended by head wheels that engage the carriage for establishing yet another means for longitudinal position adjustments necessitated by the precision required for safe rail construction.

The rough plinth strips include projecting rebar stirrups that extend upwardly and outwardly from the strips. The stirrups penetrate subsequently formed, concrete plinth structures that directly support and receive the train rails and their rail mounting structure. Concrete forms properly positioned on the plinth strips shape the resulting plinths, after concrete fills the forms. Thus the stirrups end up immersed within the upright, concrete plinth structures that are subsequently formed atop the initially formed plinth strips after the instant machine completes its work. During its operation the preferred machine clears the plinth strip stirrups, and moves along over the deck without contacting the stirrups, while providing smoothed and properly contoured channels or pathways between the plinth strips. After construction these channel pathways occupy the bottom of troughs adjacent the plinths, forming floor bottoms or scuppers as desired.

Thus, it is a basic object of the present invention to provide a self-propelled concrete finishing machine for constructing light rail systems.

Another object is to efficiently lay down and finish concrete rail beds or trackbeds.

Another basic object is to provide a machine of the character described that smoothly establishes elongated, profiled channels between adjacent plinth regions.

It is also an object to provide a deck finishing machine of the character described that screeds and finishes concrete voids between plinth regions.

Another basic object of the present invention is to enable field adjustments to adapt the machine of the character described to rail trackbeds of different sizes and configurations.

Another important object of the present invention is to provide a concrete finishing machine of the character described that includes a control panel that can be switched between machine sides for moving different directions, obviating the necessity of hoisting and then rotating the entire machine for reversing the work direction. It is a feature of this machine that a plurality of quick-connect/disconnect hydraulic fittings enable quick reversing of the machine control position without hoisting and rotating.

A still further object of the invention is to provide a concrete finishing machine of the character described including a rigid, supporting truss assembly extending over the desired rail bed for supporting horizontally and vertically adjustable and spaced-apart paving heads that engage the lower concrete surface for deck finishing.

Another object is to provide a concrete finishing machine of the character described that can be adjusted to tilt the paving heads as desired to vary the configuration of the channels.

These and other objects and advantages will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE PREFERRED EMBODIMENTS

Figure 1:
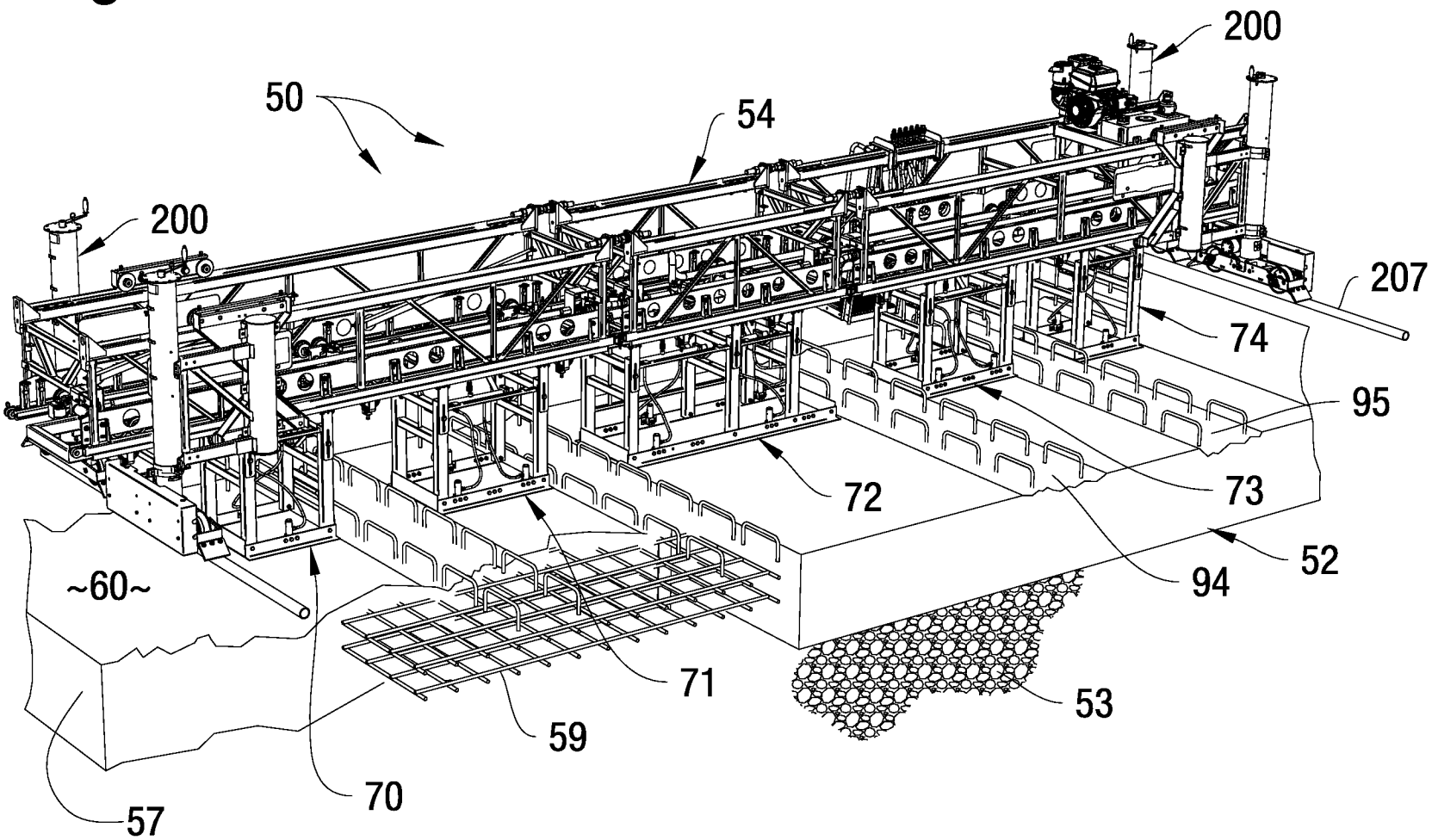
FIG. 1 is a partially fragmentary, frontal isometric of my new trackbed paver machine, showing it in use disposed upon conventional pipe rail supports proximate a partially completed concrete trackbed deck to be formed and treated in accordance with the invention.
Figure 2:
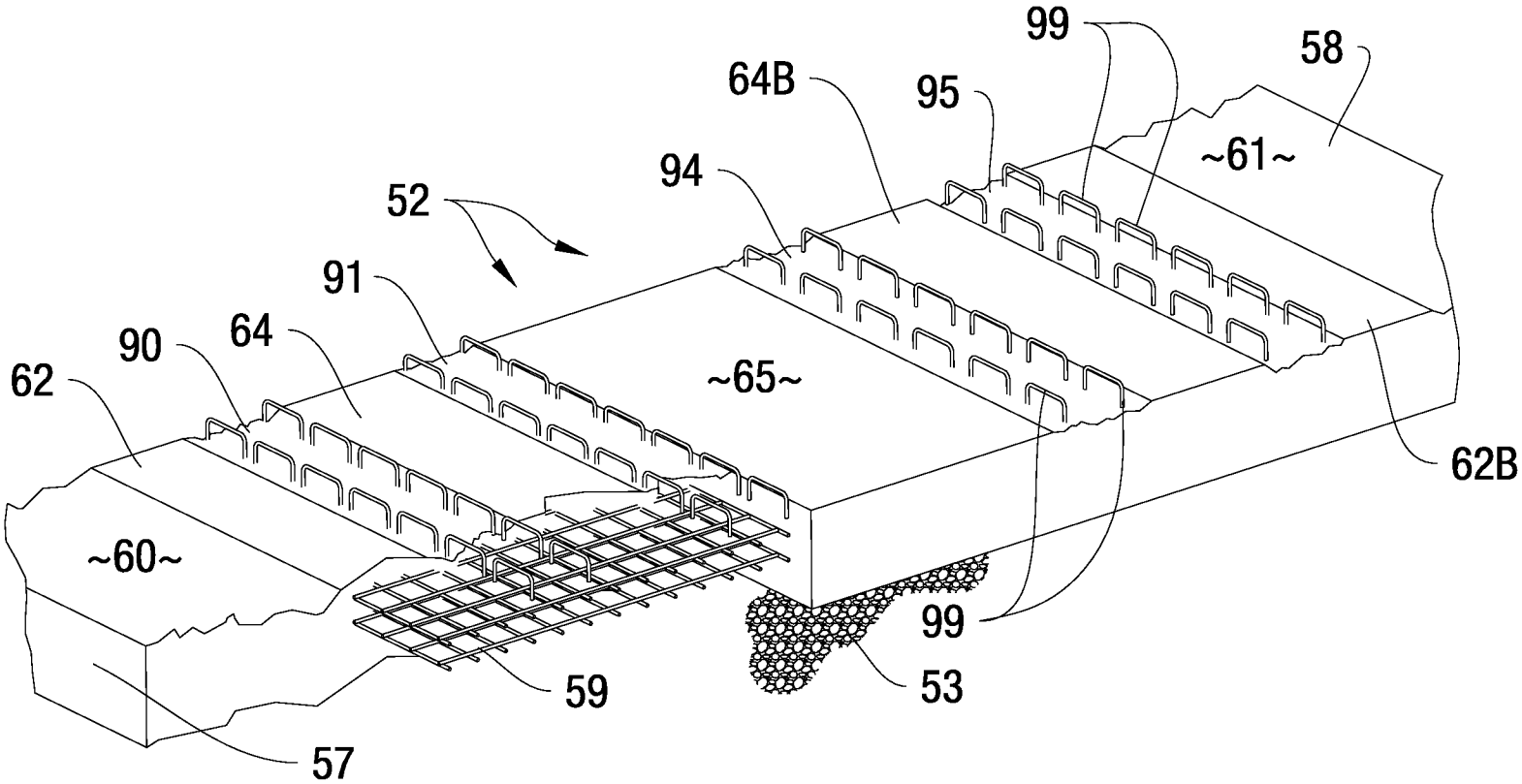
FIG. 2 is an enlarged, fragmentary, isometric view of a partially completed, concrete trackbed deck processed by the invention, showing the desired plinth strips and spaced apart channels critical to the invention, with portions thereof shown in section for clarity.
Figure 3:
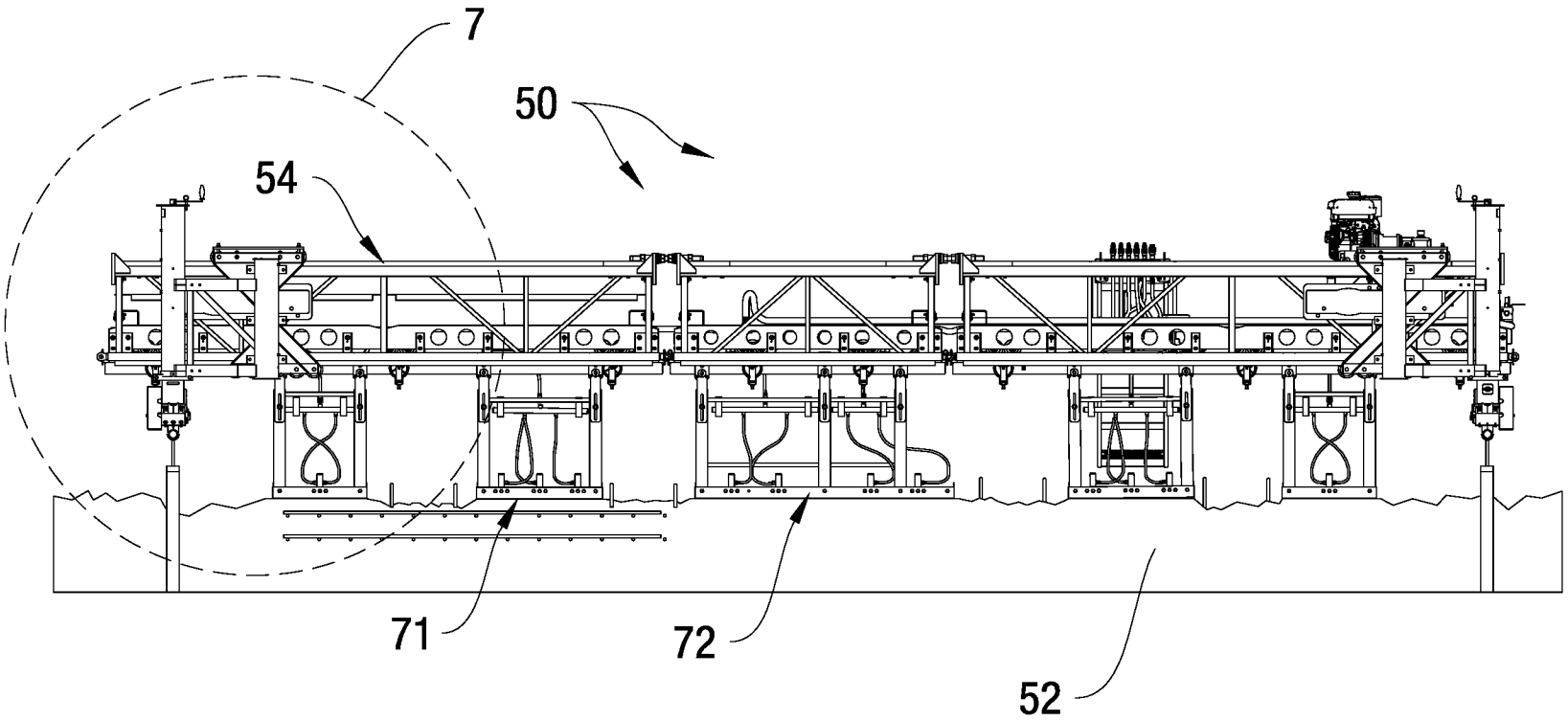
FIG. 3 is a partially fragmentary, front plan view of the trackbed deck finishing machine of FIG. 1.

With primary reference now directed to FIGS. 1-3 of the appended drawings, a trackbed deck paver constructed in accordance with the best mode of the invention known at this time has been generally designated by the reference numeral 50. In FIG. 2 of the drawings a partially completed trackbed deck that is formed and processed by the paver 50 after a concrete pour has been illustrated and designated generally by the reference numeral 52. The trackbed route will have been previously laid out by the train designers and engineers. It will follow a predetermined course over an appropriate sub-grade 53 upon which the deck 52 will be completed.

Figure 17:
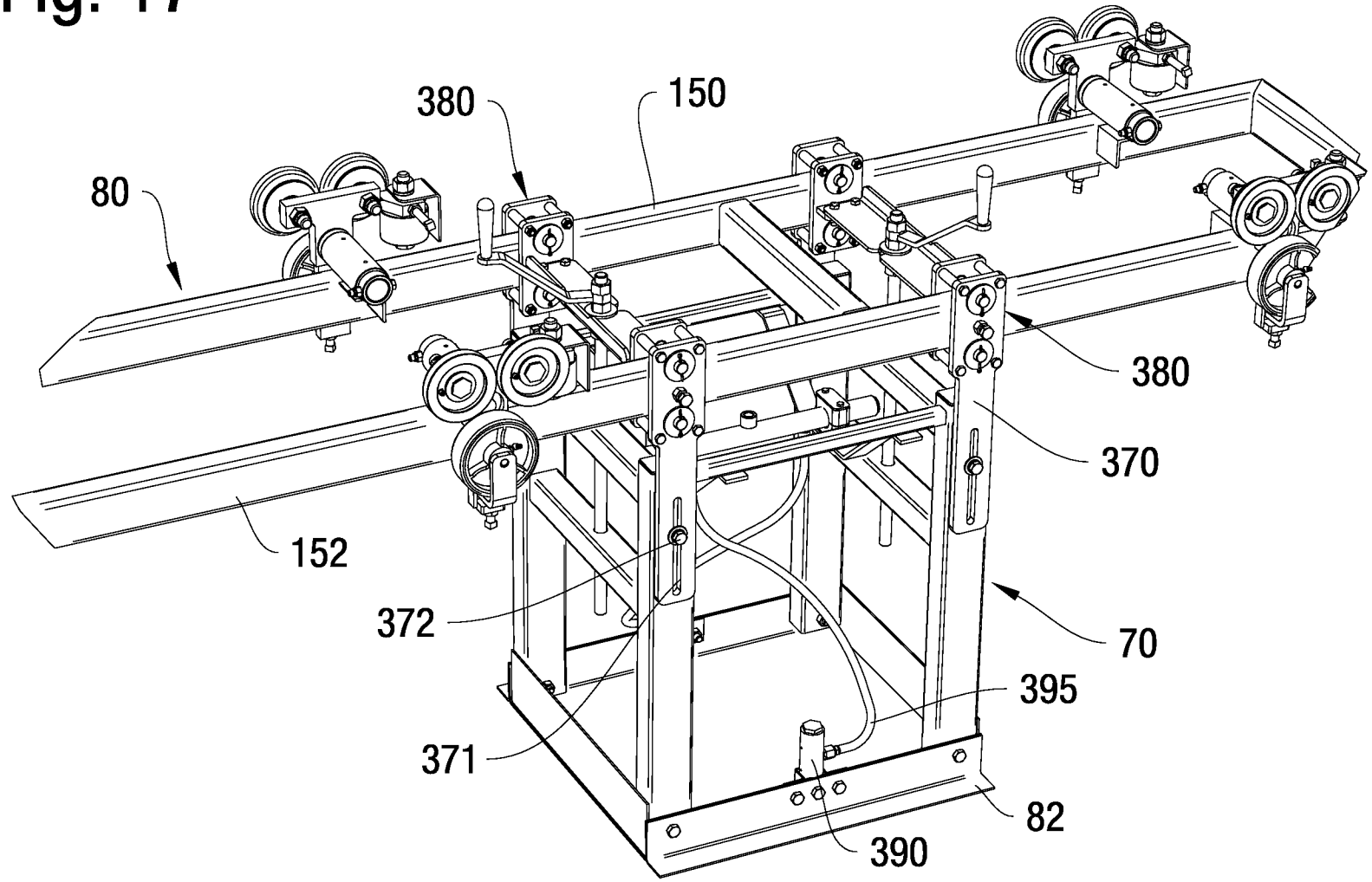
FIG. 17 is a fragmentary isometric view showing a typical paving head slidably mounted to the paver carriage.

As illustrated, deck 52 (FIG. 2) is wide enough to support two pairs of tracks, for trains running in opposite but parallel directions. Conventional, previously established concrete forms (not shown) confine plastic concrete during the pouring process between deck ends 57 and 58. Numerous pieces of conventional rebar 59 are disposed within the deck, which may be approximately thirty-six inches deep and thirty feet wide. Flat transition surfaces 60 and 61 respectively border deck ends 57 and 58. Importantly, the deck paver 50 forms smoothed channels 62 and 64, 62B and 64B, and central smoothed channel 65. These smoothed channel floors are formed by downwardly hanging paving heads 70-74 (FIG. 1) that are adjustably suspended from at least one longitudinally displaceable carriage 80 (e.g., FIGS. 4, 6) discussed hereinafter. As detailed below each paving head 70-74 has a lower concrete forming tool that engages and forms concrete as the paver 50 moves along to provide the desired profile. For example, paving head 70 (e.g., FIGS. 7, 17) has a lower forming tool preferably comprising a transverse strike-off 82 that contacts the green concrete below to form channels or floors. Importantly, there are a plurality of plinth strips defined between adjacent channel floors. For example, plinth strip 90 (FIG. 2) is located between parallel adjacent channels 62 and 64. Plinth strip 91 (FIG. 2) is parallel to and spaced apart from plinth strip 90, and is located between parallel adjacent channels 64 and 65. The plinth strips 94 and 95 for the other trackbed (i.e., at the right of FIG. 2) are similarly positioned. It is to be noted that the plinth strips support multiple, upwardly projecting rebar loops 99 arranged in parallel rows on each side of each plinth strip. After processing of the deck 52 with paver 50, a conventional concrete form (not shown) will be placed over the plinth strips covering the rebar loops 99, and filled with concrete. Once hardened the resultant plinths may support the railroad train tracks and their mounting assemblies (not shown).

Figure 4:
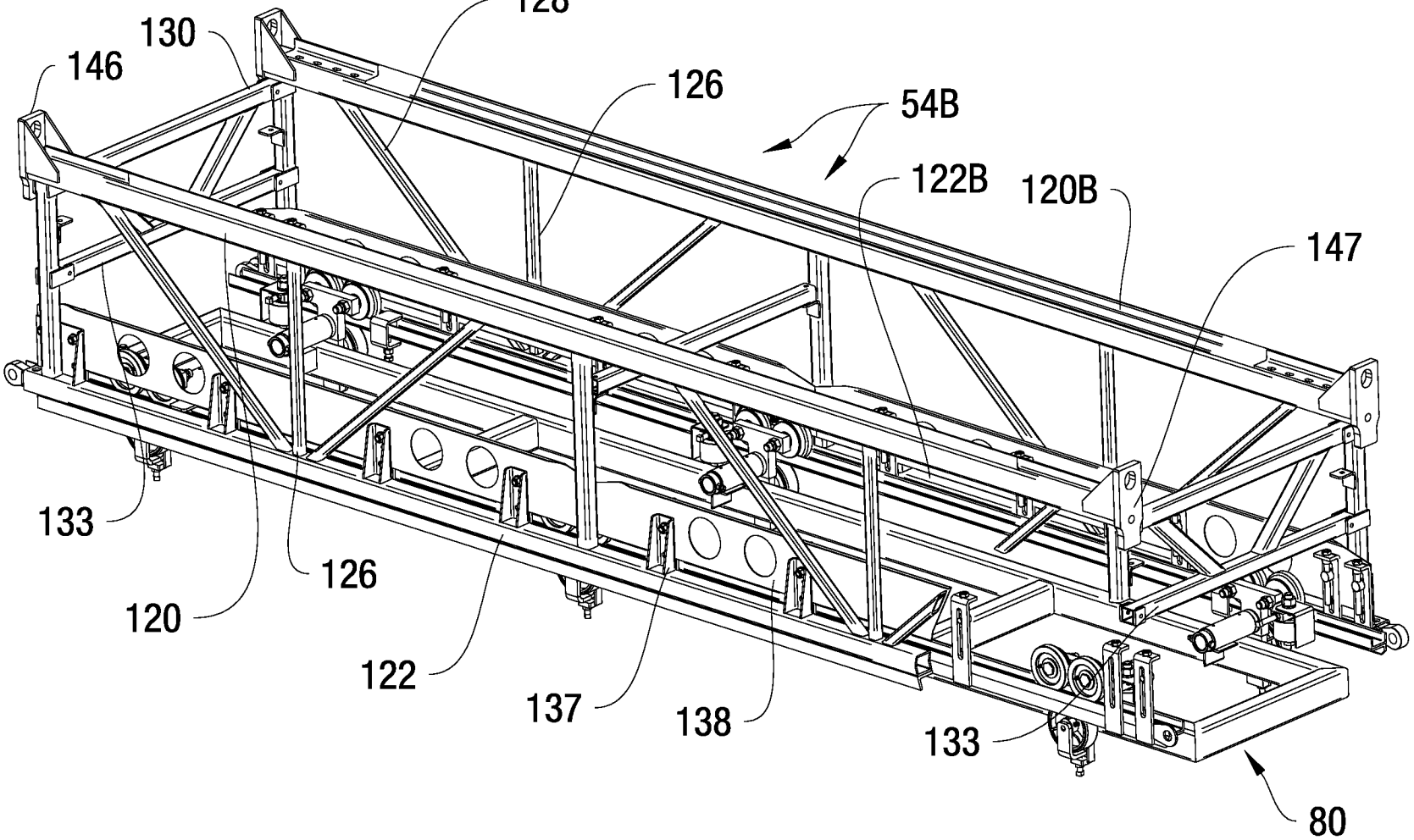
FIG. 4 is an enlarged, fragmentary isometric view of a preferred box frame segment showing the slidable carriage disposed within it.
Figure 5:
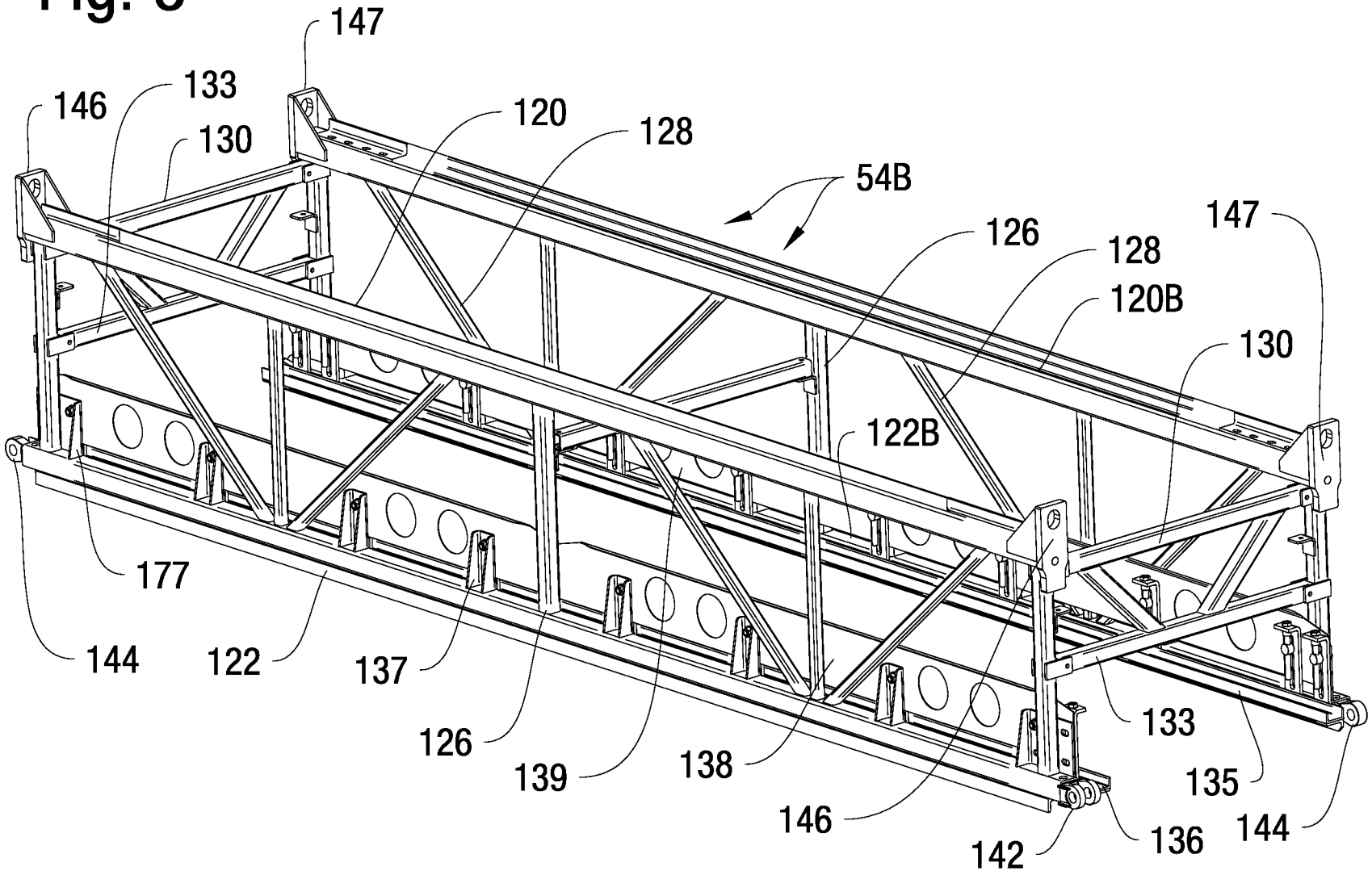
FIG. 5 is an isometric view of a preferred box frame as it appears without the carriage.
Figures 6, 6A:
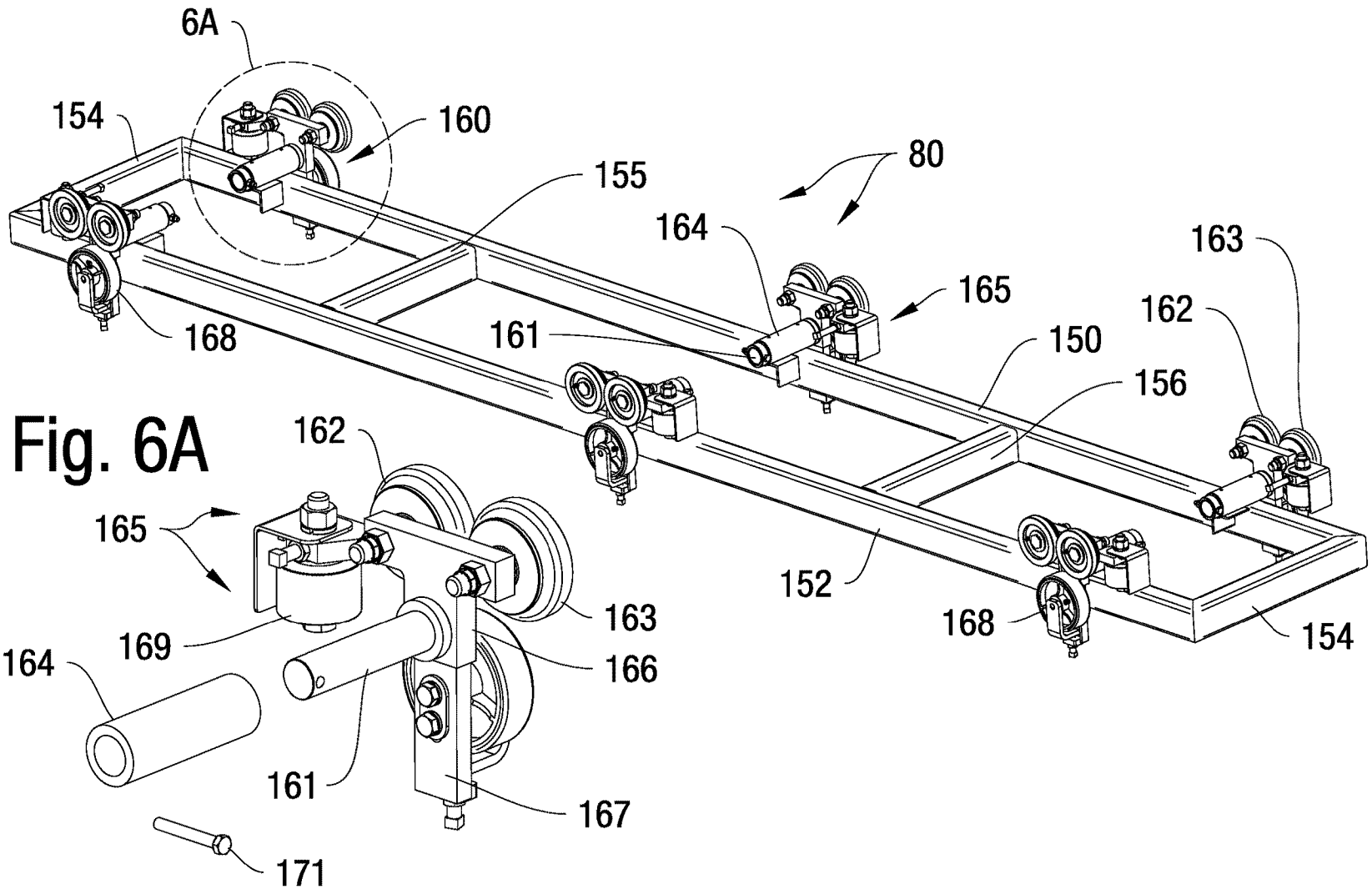
FIG. 6 is a fragmentary, isometric view of the preferred carriage that is slidably disposed within the frame.
FIG. 6A is an enlarged, isometric view derived from circled region "6A" in FIG. 6.

With joint reference now directed to FIGS. 4-6, the machine frame 54 can comprise one or more elongated box frame segments 54B that can be coupled together to form a frame of a desired length. The composite frame 54 (FIG. 1) internally receives and suspends the carriage 80 (FIG. 6) for limited slidable movements. The frame 54 is generally rectilinear in appearance, in the form of a parallelepiped. It has a pair of spaced apart sides formed by pairs of upper side rails 120 and 120B and lower side rails 122 and 122B (FIG. 4). The frame side rails are maintained in vertically spaced apart, parallel relation by multiple vertical frame braces 126 and angled frame braces 128. Pairs of spaced apart end struts 130, 133 extending between upper side rails 120, 120B and lower side rails 122 and 122B form the rigid ends of the frame 54. Importantly, the bottom side rails 122, 122B support parallel, elongated carriage tracks 135, and 136 (FIG. 5) that are secured by a plurality of rigid, spaced apart bracket supports 137. Elongated wheel guards 138, 139 (FIGS. 4, 5) laterally restrain the carriage support wheels discussed below as they ride upon tracks 135 and 136.

Multiple frame segments 54B of varying lengths can be coupled together longitudinally to form the frame 54 of varying frame lengths. To this effect, it is to be noted that the bottom of each frame segment 54B (FIG. 5) has a female coupling 142 at the right end at the left bottom corner and another similar female coupling at the other end, at the right bottom corner. There are complimentary male couplings 144 at the right end at the right bottom corner, and at the left end at the left bottom corner. These male and female couplings enable adjacent frame segments to mate. There are also pairs of upper mounting flanges 146 and 147 (FIG. 5) for locking frame segment ends together at their tops.

The elongated carriage 80 is slidably suspended from frame segment tracks 135, 136 discussed earlier. The carriage comprises a pair of spaced apart, rigid side bars 150 and 152 (FIG. 6) secured in parallel relation by end braces 154 and intermediate cross braces 155, 156. There are three pairs of wheel assemblies 160 for suspending the carriage 80 within the frame 54 (i.e., segments 54B). Each wheel assembly 160 comprises a pair of upper suspension wheels 162, 163 that ride upon carriage tracks 135 and 136 within the frame 54 and the longitudinally aligned frame segments 54B. Wheels 162, 163 are mounted for rotation upon bracket assembly 165, that comprises a rigid, T-shaped trolley mount 166 whose bottom portion 167 rotatably secures confinement wheels 168 and side support roller 169. Tubular gudgeons 161 (FIGS. 6, 6A) are secured to and project away from trolley mounts 166 (FIG. 6A). Gudgeons 161 secure the bracket assembly 165 to the carriage when slidably engaging the pintles 164 that are welded to the carriage side rails 150, 152. Suitable retainers such as pins 171 secure the pintle-to-gudgeon connection. The lower confinement wheels 168 abut against the underside of the tracks 135, 136 to resist misalignment.

Figure 9:
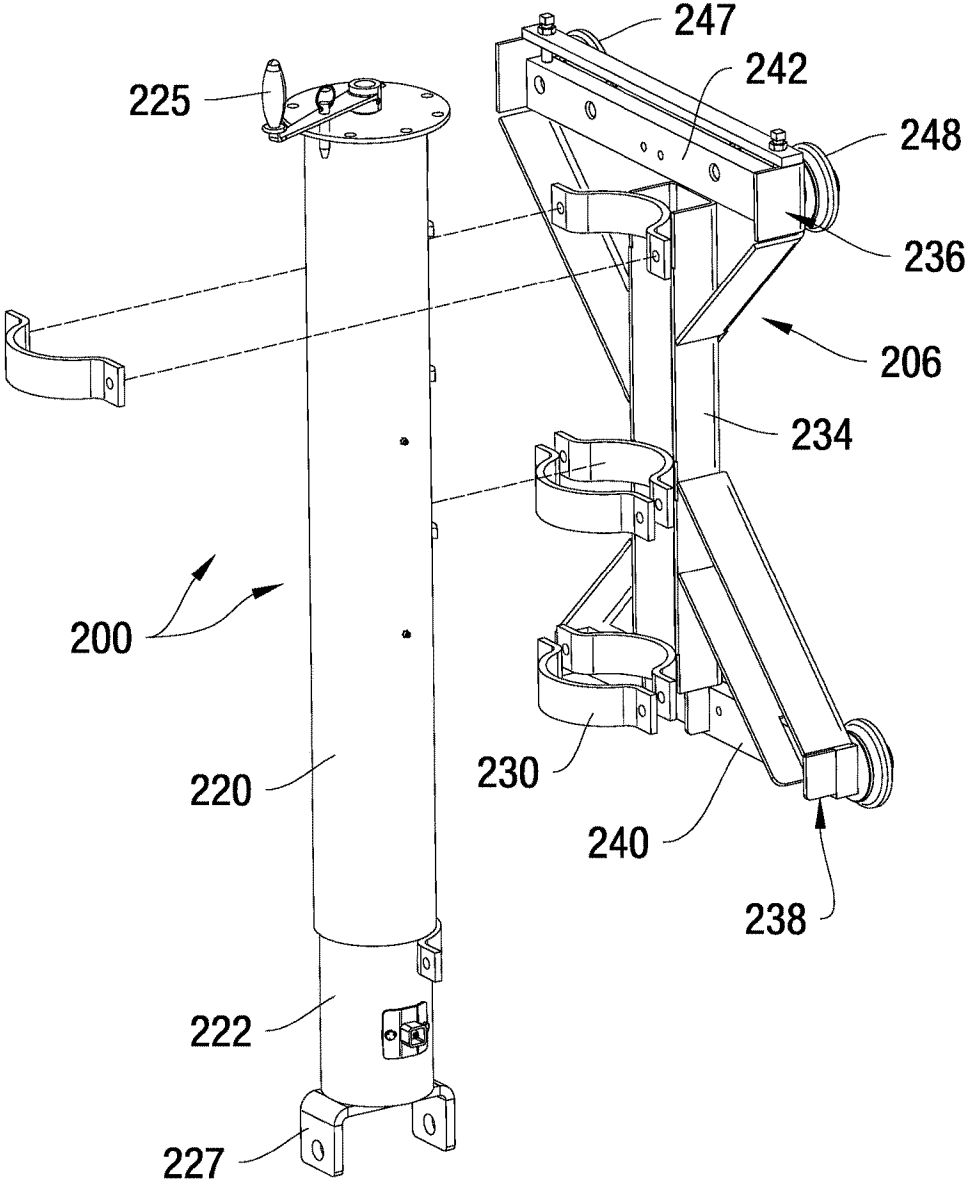
FIG. 9 is a partially exploded, isometric assembly view showing the jack plate mounting system for fixedly securing the jack-stands directly to the frame, with portions thereof omitted for clarity.
Figure 10:
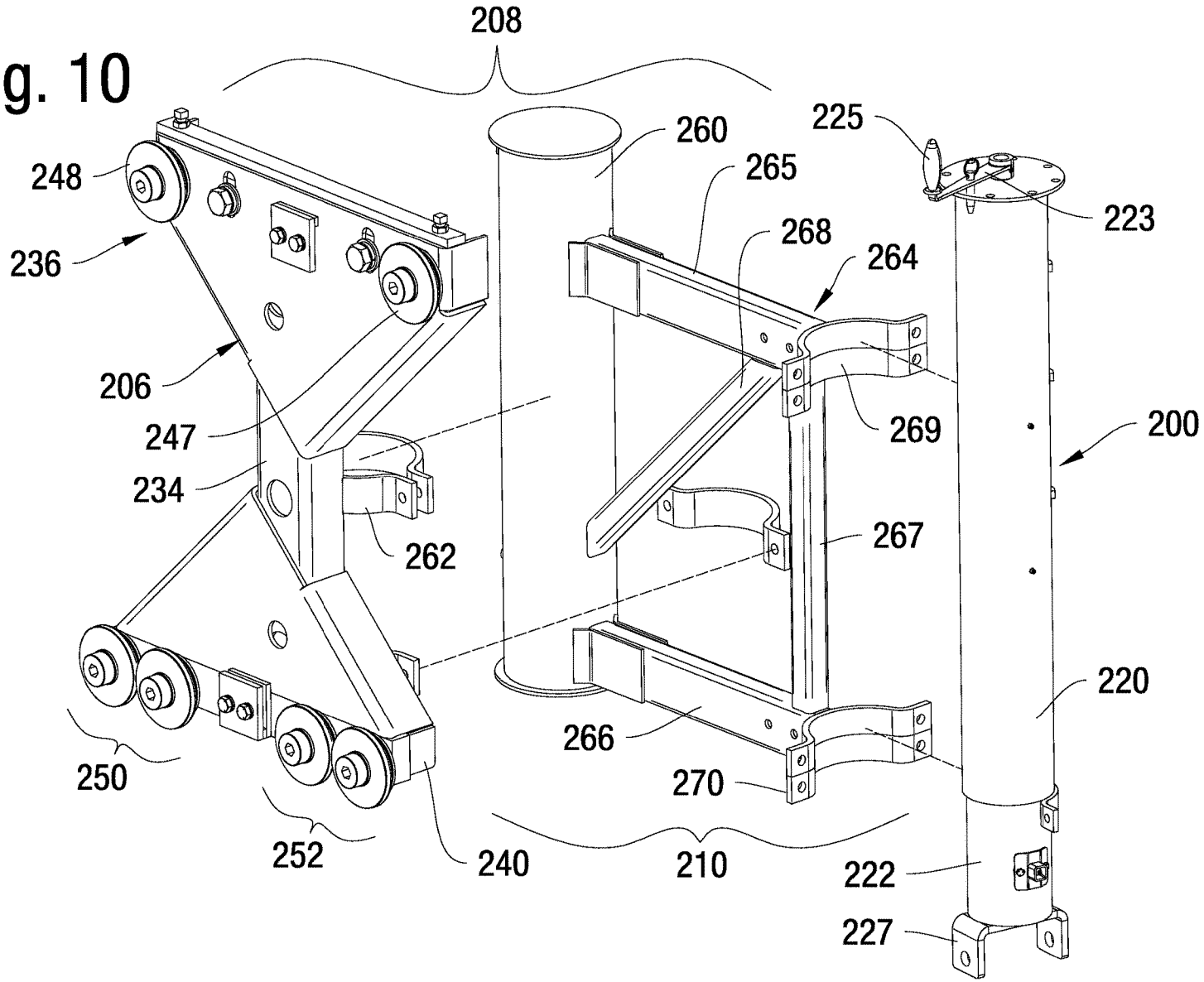
FIG. 10 is a partially exploded, fragmentary isometric view of an optional swing-out mounting arrangement adapting a jack stand for radial movements towards or away from the frame.

The paver 50 has a plurality of upright, adjustable jack stands 200 described in detail below for support and locomotion. There preferably are four jack stands, one at each corner of the paver 50 (FIGS. 1, 3). The jack stands 200 comprise lower, wheeled bogies for support. The drive bogies 204 (FIG. 13) effect locomotion and the non-driven bogies 203 (FIG. 14) merely provide support; both ride along and upon the conventional forms (i.e., pipe rails) 207 provided on each side of the deck prior to the concrete pour. Each jack stand 200 is secured to the paver frame 54 (i.e., an adjacent frame segment such as 54B) with a rigid jack plate 206 (FIGS. 9 and 10). FIG. 9 shows the arrangement wherein a jack-stand 200 is fixedly mounted directly to the paver frame 54 with the jack plate 206. In FIG. 10 it is seen a jack-plate 206 may be associated with an optional swing-out assembly 208 that includes a pivot adaptor 210 for enabling radial displacements of a jack stand 200 from the paver frame. In the fixed or direct mounting arrangement of FIG. 9 there is no swing out assembly 208 or pivot adaptor 210.

With joint primary reference directed now to FIGS. 1 and 8-10, a typical jack-stand 200 that is preferably employed by the invention is a telescoping device that may be varied in length to change paver elevation. Each jack-stand comprises a rigid cylinder 220 that coaxially receives an internal, extensible jack-stand foot 222 that is threadably controlled within cylinder 220 by a manually activated crank 223 driven by handle 225 (e.g., FIGS. 9, 10, 12). The foot 222 mounts a lower, rigid clevis 227 (e.g., FIG. 14) that is pinned to a wheeled drive bogie 204 (FIG. 13) described in more detail below. In the fixed arrangement of FIG. 9, the jack-stand 200 is directly coupled to the jack plate 206, with the cylinder 200 secured to the jack plate with a plurality of clamps 230 that unite each jack stand with a jack plate 206.

Figure 7:
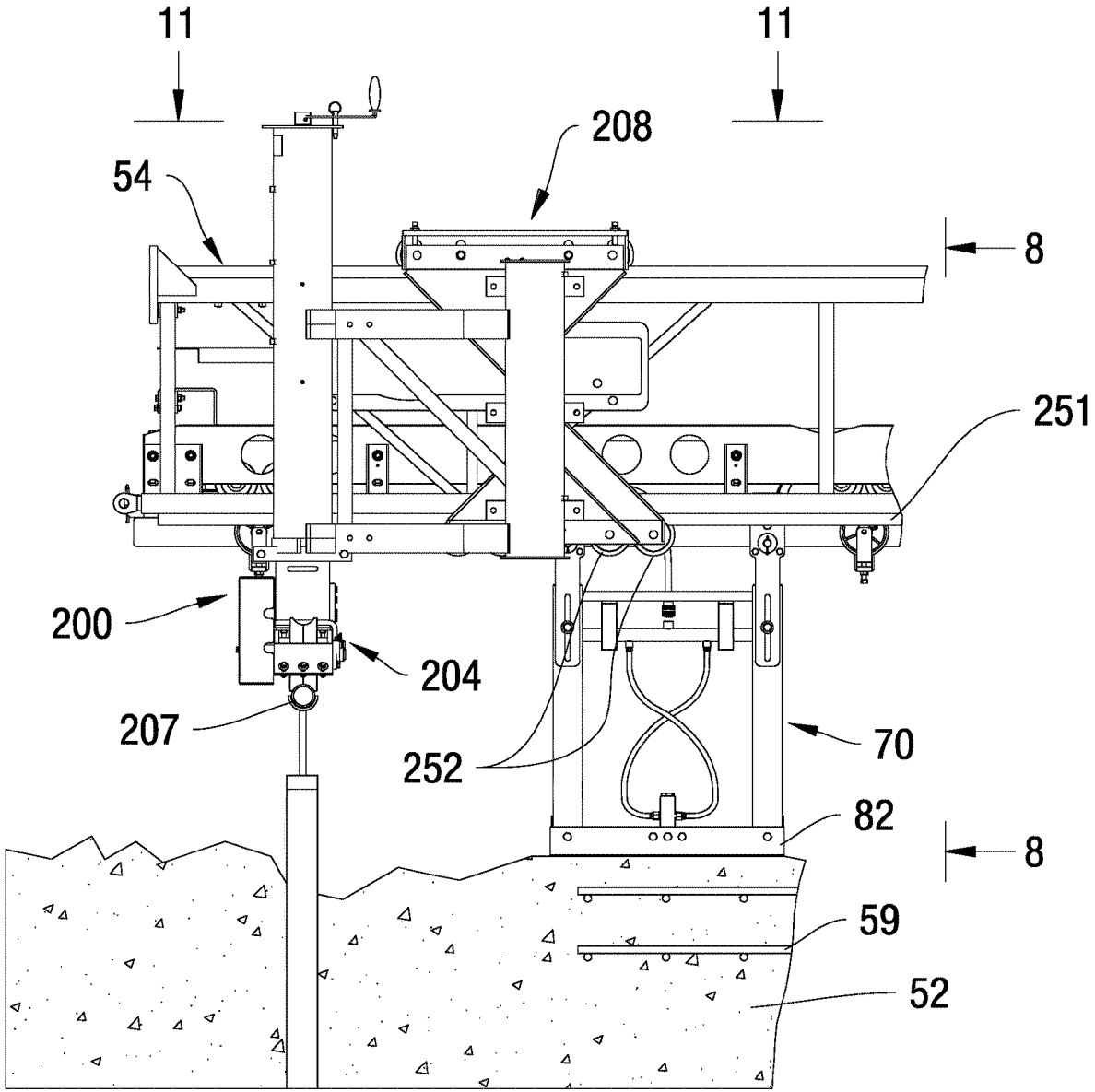
FIG. 7 is an enlarged, fragmentary plan view derived from circled region "7" of FIG. 3, showing preferred jack stand and paving head detail.
Figure 8:
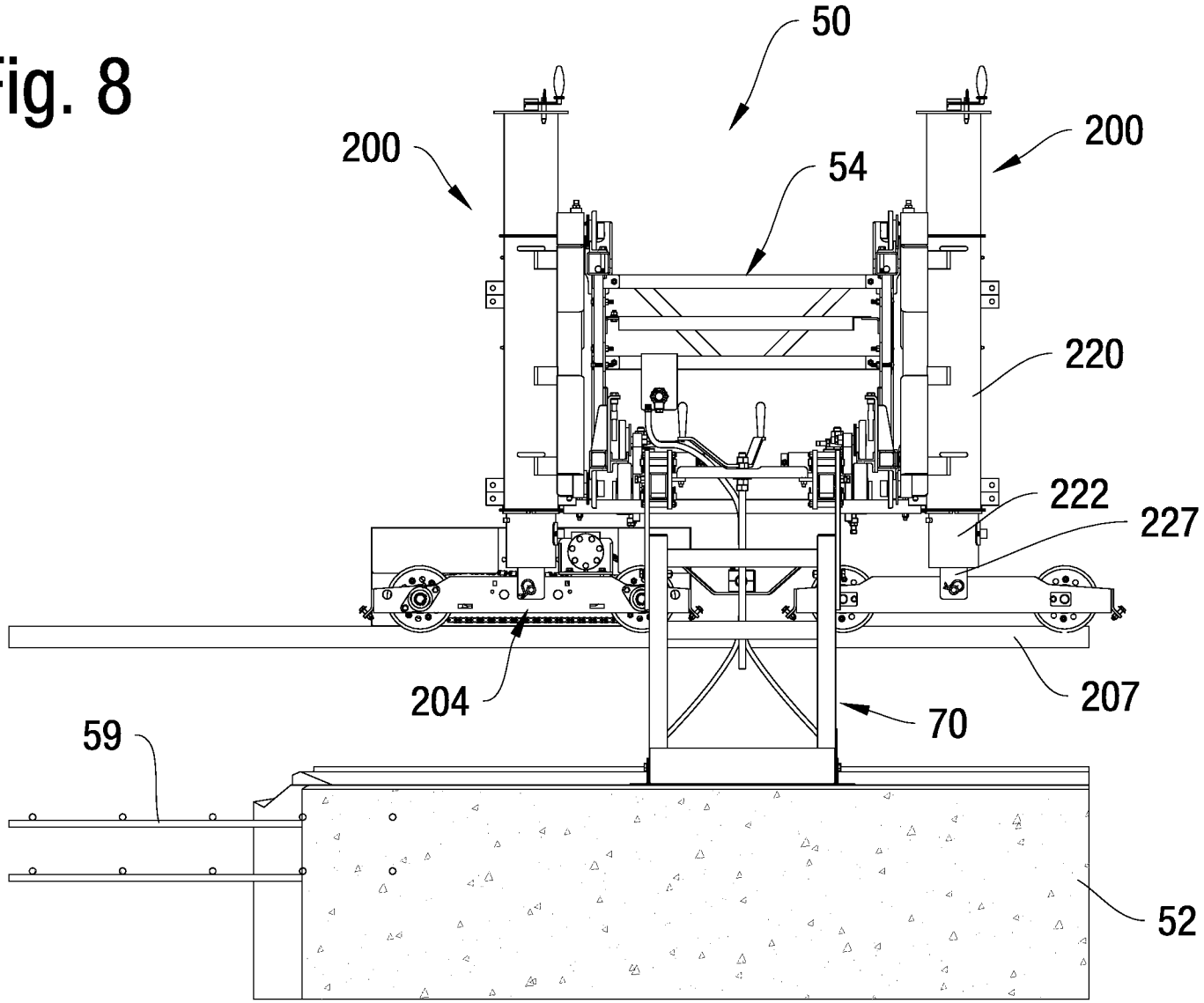
FIG. 8 is an enlarged, partially fragmentary sectional end view taken generally along line 8-8 in FIG. 7 in the direction of the arrows.

The outermost side of a jack plate 206 is best seen in FIG. 9, and the opposite inner side of a typical jack plate 206 is best seen in FIG. 10. Each jack plate 206 comprises a rigid, internal vertical strut 234 that extends between upper and lower, generally triangular tops 236 and bottoms 238 (FIG. 9) which are respectively reinforced by cross-braces 240 and 242. The triangular tops 236 support spaced-apart roller wheels 247 and 248 (FIG. 9) that roll along the support track 249 (FIG. 12) on frame 54. The triangular jack plate bottoms 238 (FIG. 10) support spaced apart roller wheel pairs 250 and 252 contact suitable frame rails 251 (FIG. 7).

Figure 11:
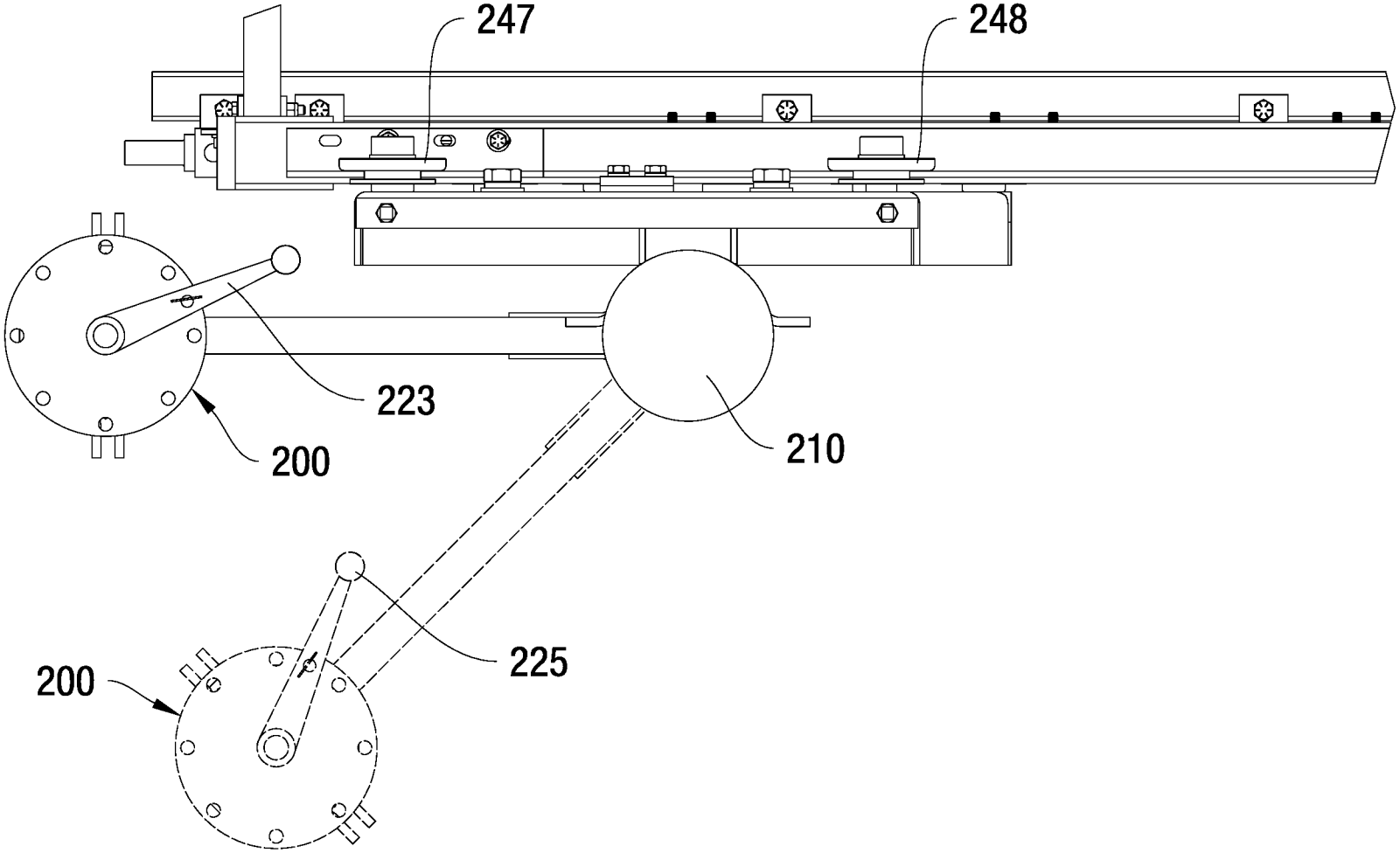
FIG. 11 is a fragmentary top plan view illustrating jack-stand radial deflections, taken generally along line 11-11 of FIG. 7, and with moved positions illustrated in dashed lines.
Figure 12:
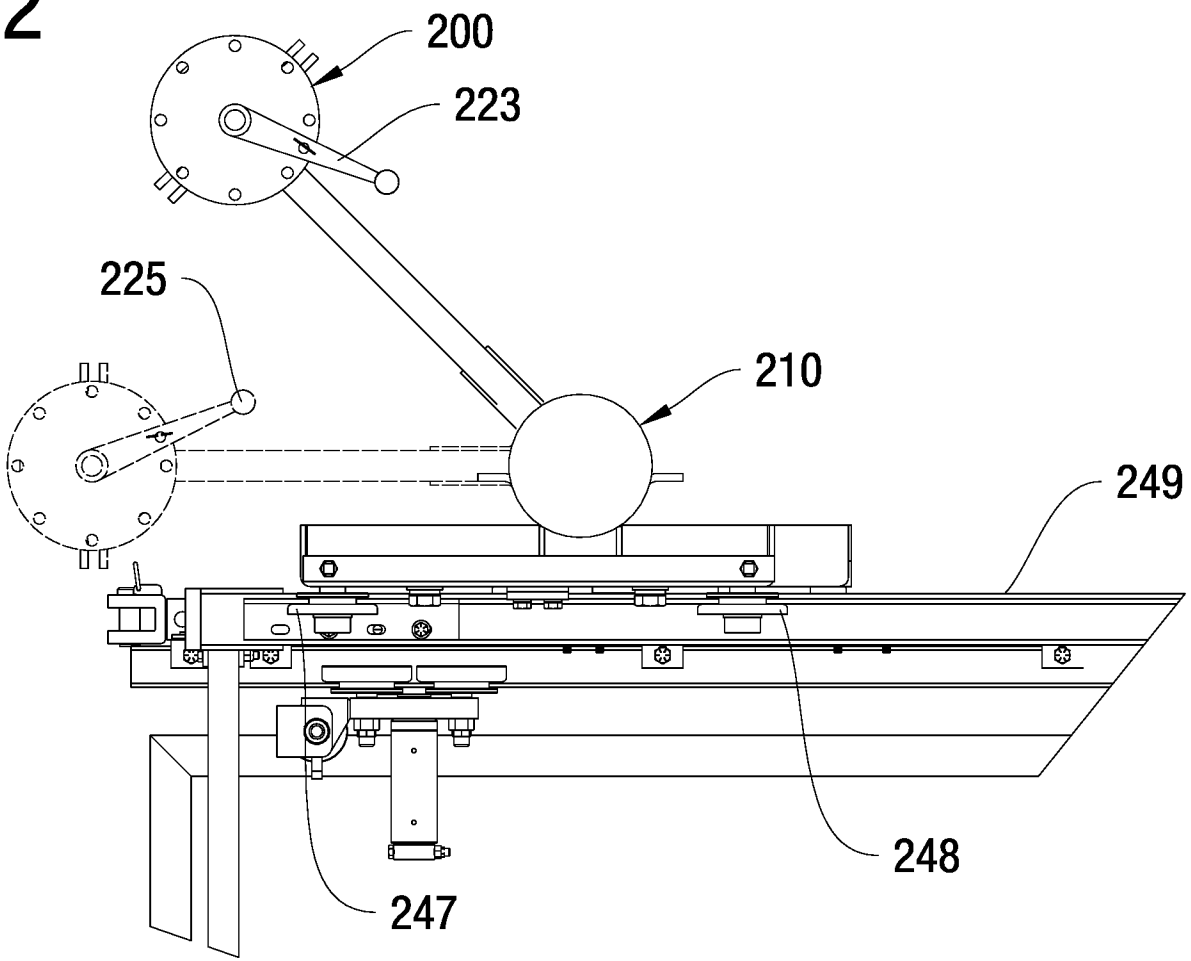
FIG. 12 is a view similar to FIG. 11 but showing another jack-stand on an opposite frame side in one of several possible radially advanced positions enabled by a swing-out assembly, and with moved positions illustrated in dashed lines.

In some cases it is helpful to be able to radially shift the position of the jack-stands 200 for clearance purposes, so the swing-out assembly 208 (FIG. 10) including a pivot adaptor 210 is employed. The optional pivot adaptor 210 comprises a rigid tube 260 that can be secured to a jack plate 206 with a clamp 262. The adaptor 210 comprises a rigid, box-like standoff 264 comprising rigid, parallel arms 265 and 266 connected to support stanchion 267 and reinforced by angled cross-piece 268. The upper and lower clamps 269 and 270 secure the pivot adaptor 210 to a jack-stand 206 by mechanically engaging jack-stand cylinder portion 220 (FIG. 10). With clamp 262 (FIG. 10) loosened, radial jack-stand movements illustrated in FIGS. 11 and 12 are enabled.

Figure 13:
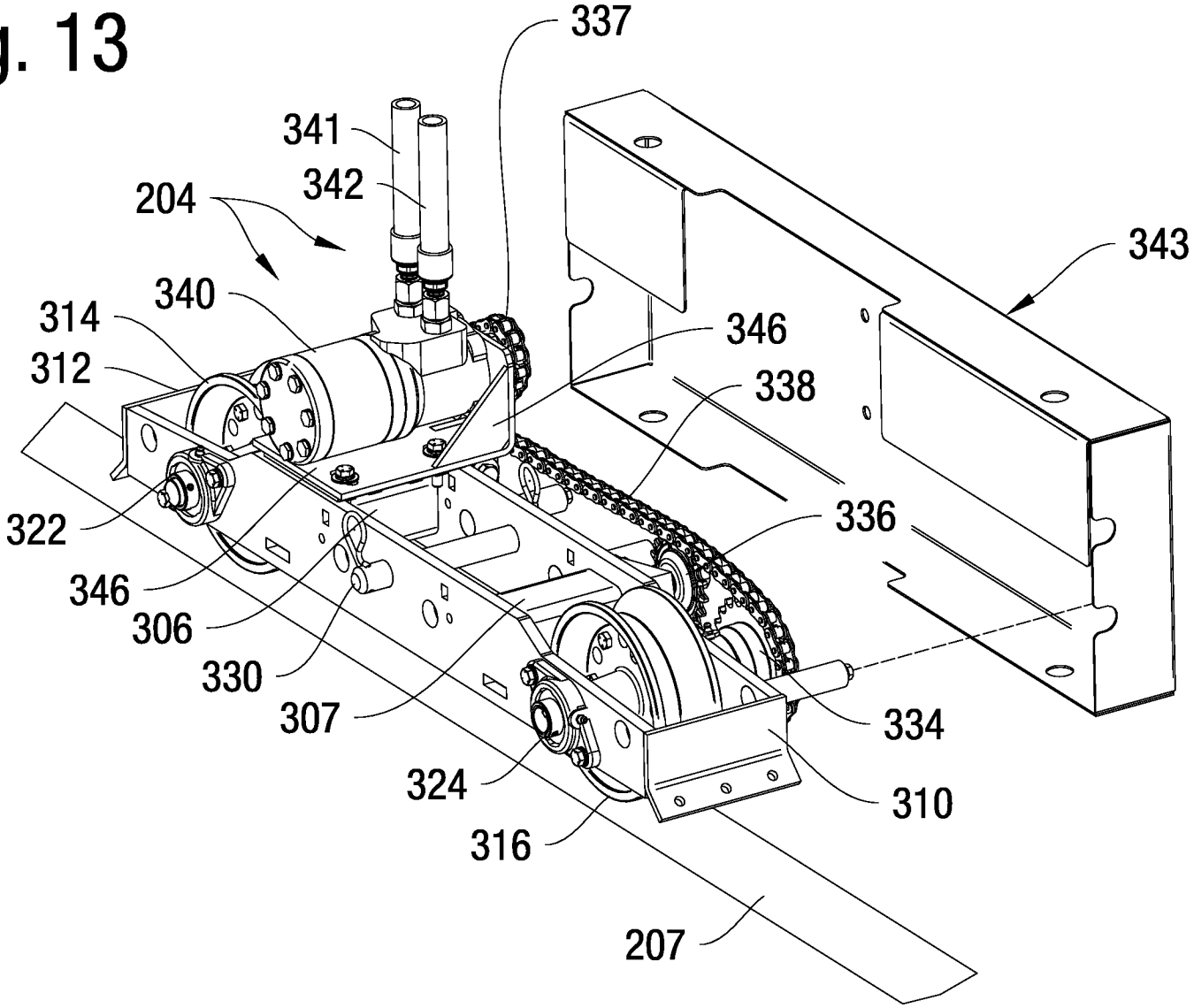
FIG. 13 is an enlarged, partially exploded, fragmentary isometric view of a typical drive bogie that supports and displaces the preferred jack-stands.
Figure 14:
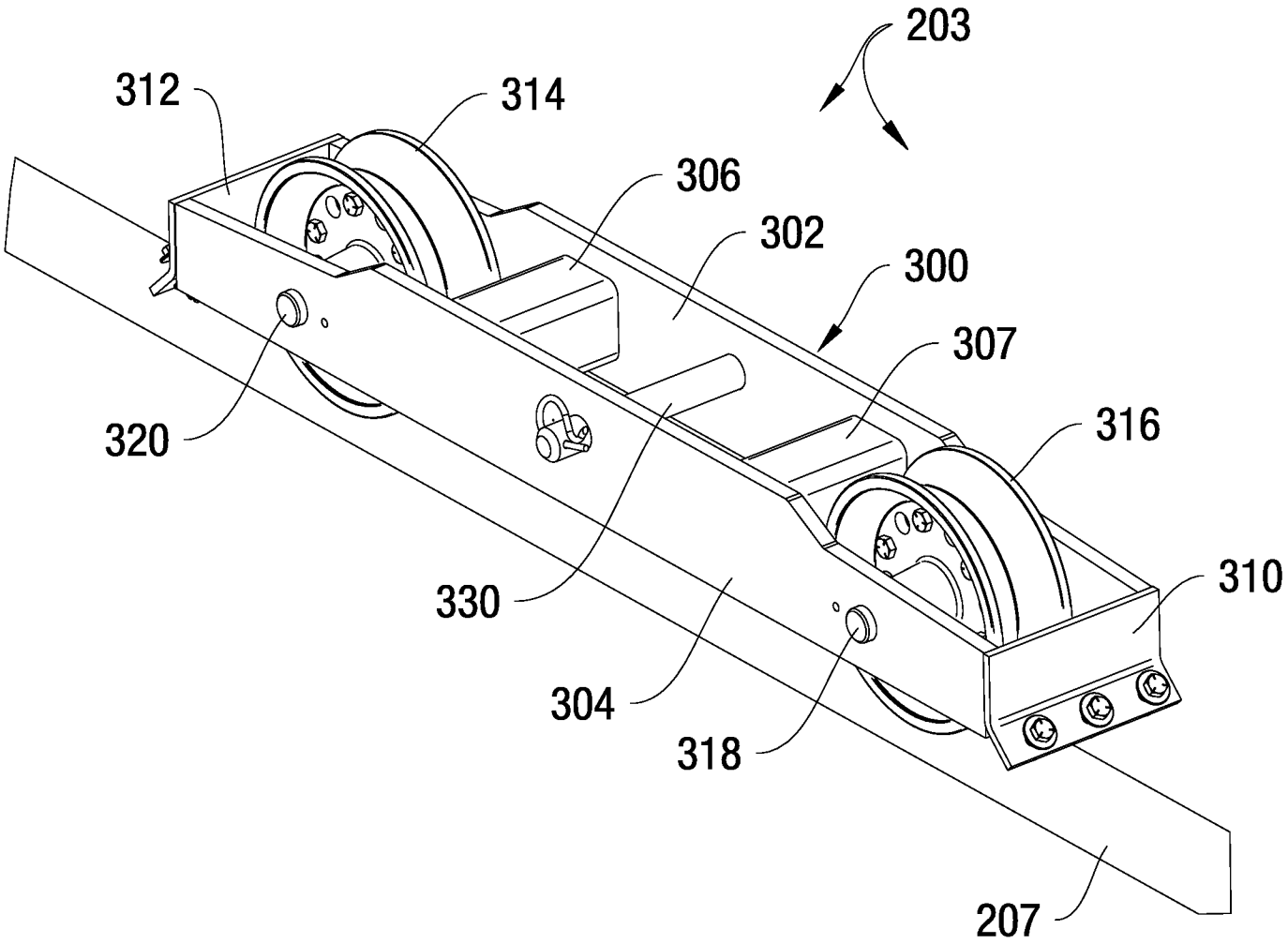
FIG. 14 is an enlarged isometric view of a driven bogie chassis.

FIGS. 13 and 14 illustrate a preferred jack stand bogie in detail. The various undriven bogies 203 and driven bogies 204 support the paver 50 above the deck 52 during operation and enable paver movement. Bogies 203, 204 ride along pipe rails 207 as explained earlier. Each bogie comprises a rigid chassis 300 (FIG. 14) that comprises rigid, generally rectangular and spaced-apart side plates 302 and 304 that are reinforced by internal cross braces 306 and 307. The chassis ends comprise angled end plates 310 and 312. Drive wheels 314 and 316 are journaled by axles 318 and 320 respectively, that penetrate chassis side plates 302 and 304 and are rotatably secured by various pillow blocks 322 and 324. A removable pin 330 (FIG. 14) penetrating chassis side plates 302 and 304 secures the previously described jack stand clevis 227. With the driven bogies 204 drive wheels 314 and 316 are splined to suitable drive sprockets 334, (FIG. 13) that are driven by chain 338 (FIGS. 13, 14) that engages idler sprocket 336 and drive sprocket 337. The drive sprocket and the drive wheels are driven by hydraulic propulsion motor 340 connected to hydraulic lines 341 and 342. A rigid motor support 346 extending between the chassis sides secures the motor 340. A somewhat cubicle cover 343 shrouds the bogie.

A typical paving head 70 discussed earlier is seen in detail in FIGS. 15-17. Each paving head is slidably coupled to the carriage 80 (FIG. 17) which, as mentioned, is slidably received within the paver frame. The box-like paver heads may vary in width between twenty-four to ninety-six inches, depending on the application and its assigned dimensions.

Figure 16:
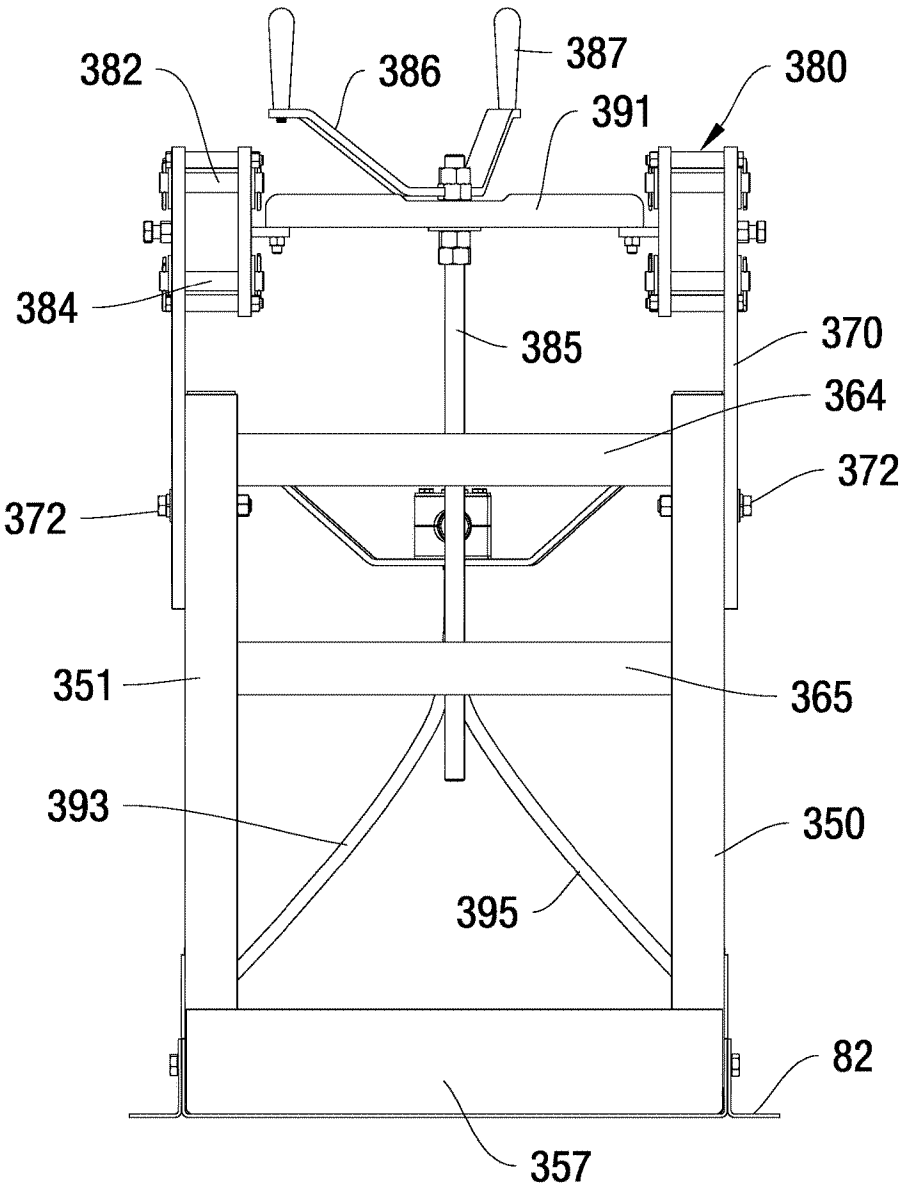
FIG. 16 is an end view of a paving head, taken from a position generally to the left of FIG. 15.

Each generally cubicle paving head comprises four extensible, parallel corner struts 350, 351, 352 and 354 that extend from lower strike-offs 82 and side braces 356 and 357 upwardly to upper frame members 360, 361 and frame bars 362-365. The corner struts all have upper extensions 370 that lead to box-like roller cages 380 (FIG. 16) that surmount carriage side bars 150, 152 (FIG. 17) for locomotion with upper internal rollers 382, and lower captivation rollers 384 (FIG. 16).

The paving heads are adjustable in length with a pair of spaced-apart, hand driven cranks. The roller cages 380 are secured to extensions 370 that have slots 371 (FIGS. 15, 17) through which fasteners 372 extend into engagement with the paver corner stanchions, enabling adjustable mounting.

Figure 15:
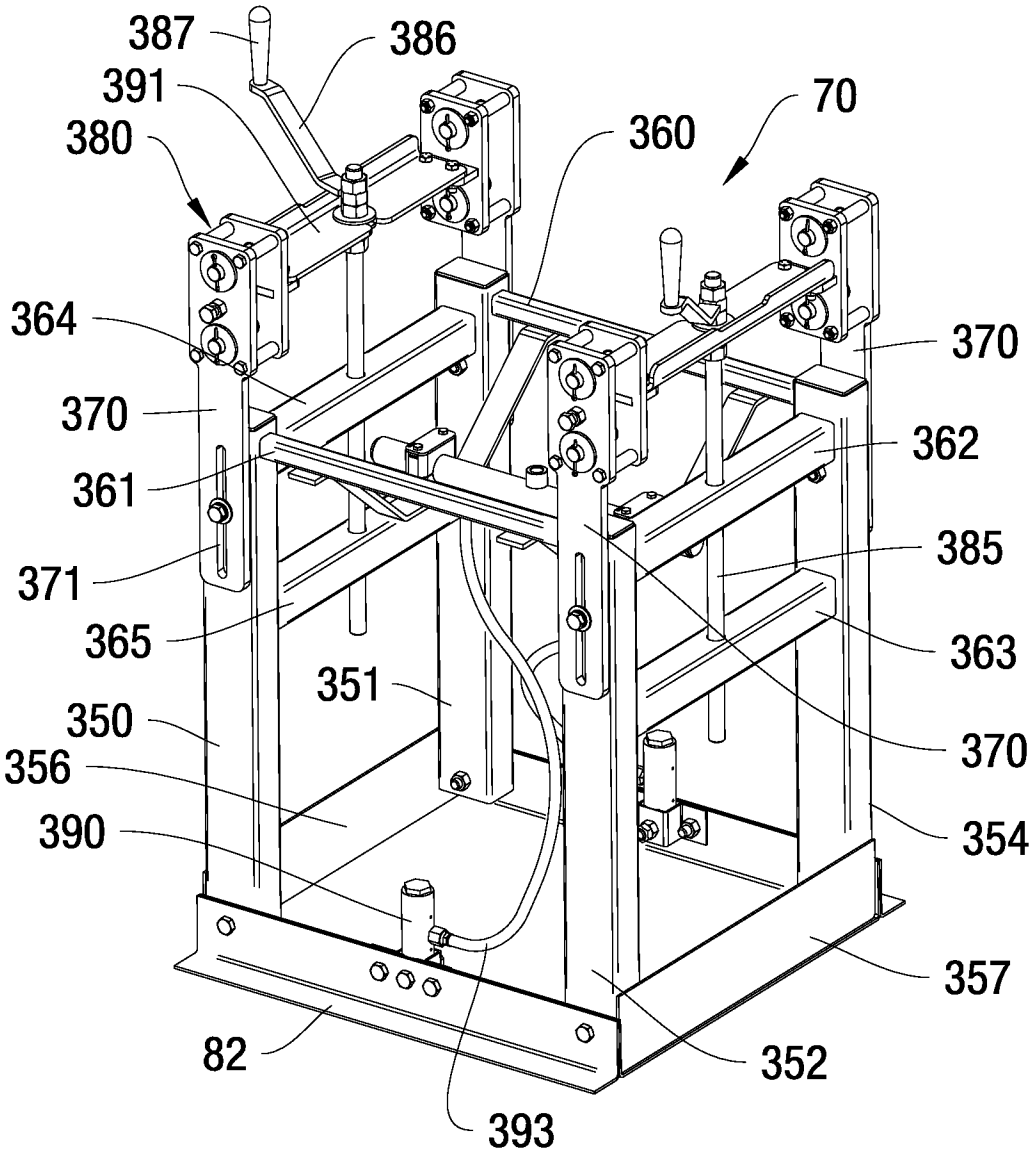
FIG. 15 is an enlarged isometric view of a preferred paving head.

The cross pieces 391 extending between opposite roller cages 380 (FIGS. 15, 16) support threaded shafts 385 that can be rotated with cranks 386 and handles 387. Shaft 385 is threadably coupled to lower paver head frame bars 364 and 365 to vertically adjust the paver head position, providing locking fasteners 372 are loose within slots 371 (FIG. 15). Suitable vibrators 390 secured to the strike-offs 82 (FIG. 15) are powered by lines 393 and 395 (FIG. 16) to vibrate the strike-offs during operation. The vibrators are preferably pneumatic but hydraulic vibrators are acceptable.

Figure 18:
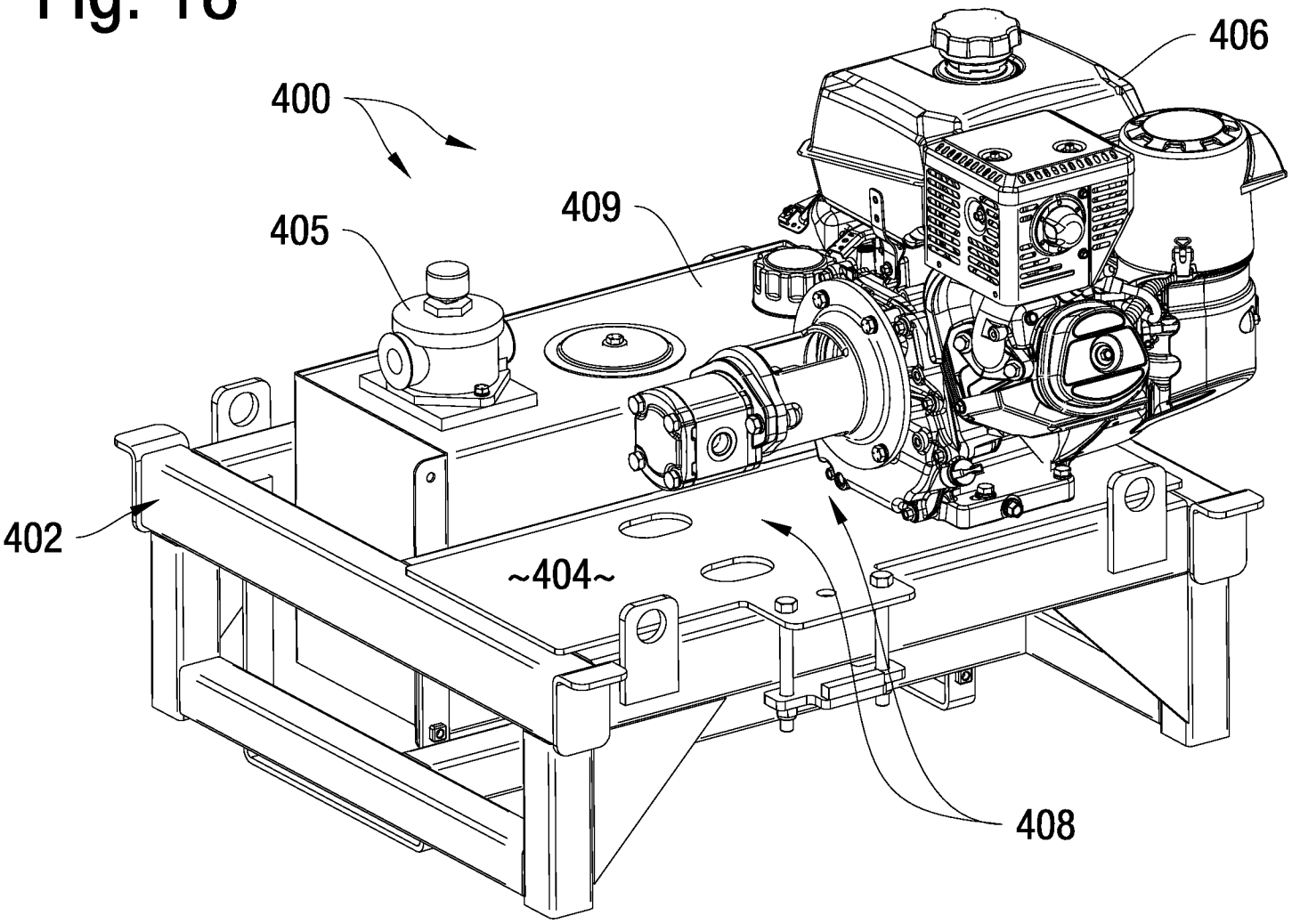
FIG. 18 is an isometric view of the preferred power unit.

FIG. 18 shows the preferred power unit 400 for the paver 50. A rigid, generally cubicle subframe 402 adapted to be mounted to box-frame 54 provides a generally planar mounting surface 404 for mounting a standard internal combustion motor 406, that comprises a gasoline motor of between fourteen to fifty horsepower. Tank 409 stores hydraulic fluid for the system and mechanically mounts a hydraulic fluid filter 405. Internal combustion motor 406 powers a conventional hydraulic pump 408 that ultimately provides hydraulic fluid flow through hydraulic lines 341 and 342 (FIG. 13) for powering the bogie drive motor 340 that moves the jack stands and ultimately the paver 50.

Figure 19:
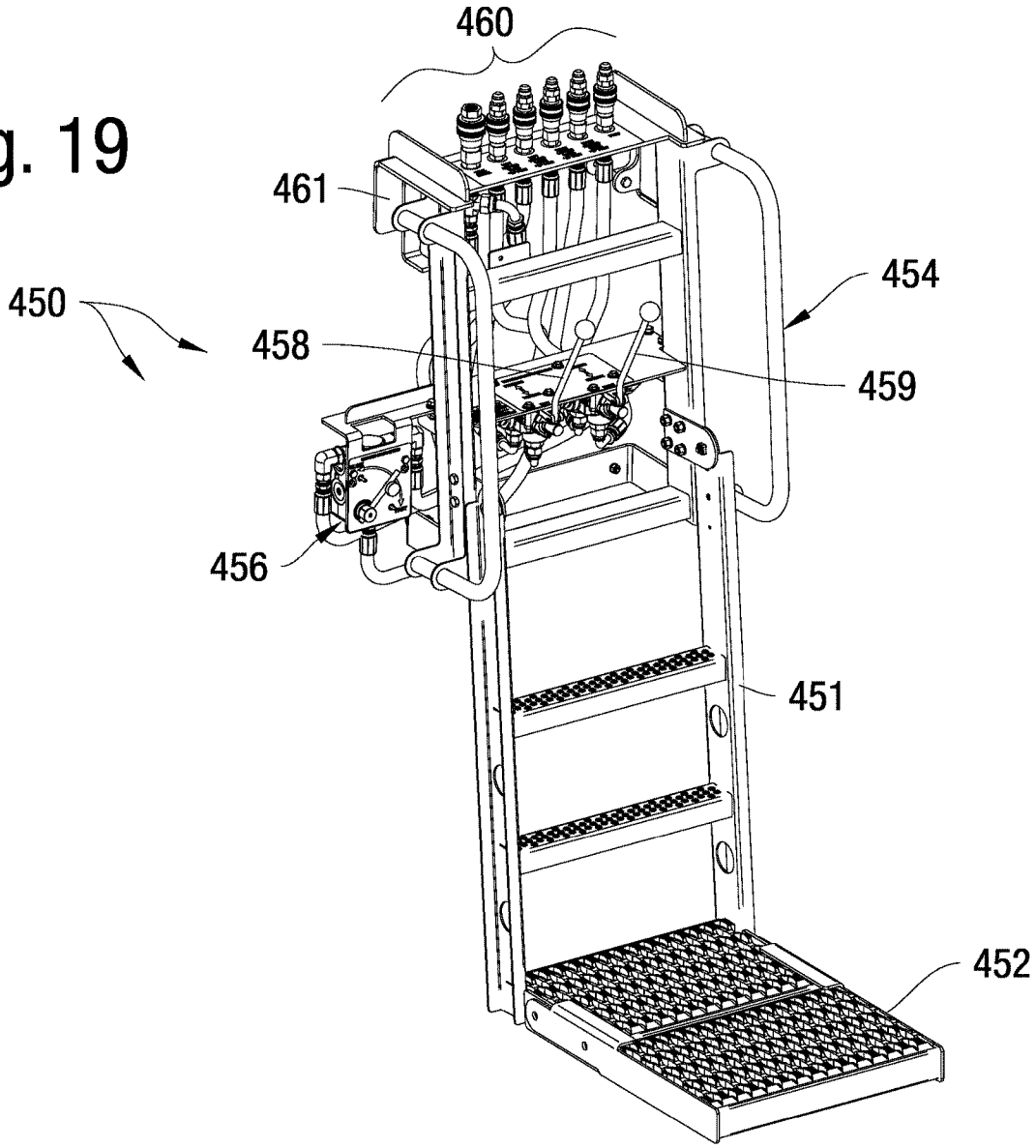
FIG. 19 is an isometric view of the preferred controller.

Preferably the paver 50 is manually controlled by an operator (not shown) who may stand on the removable control unit 450 that can be fitted to either side of the frame 54. The control unit 450 comprises an upright ladder section 451 comprising a bottom foot stool portion 452 and an upper handrail section 454. Suitable hydraulic control circuitry 456 can be actuated by the operator with valves 458 and 459 to control paver speed. The hydraulic circuitry 456 routs fluid throughout the paver, and to its hydraulic components such as the drive motor 340, via quick-connect/disconnect fittings known in the art that are collectively designated by the reference numeral 460. The various snap-connections that engage these fittings 460 and be reconnected quickly by a workman from an opposite side of the paver 50 after the control unit 450 is mechanically moved to another side of the paver form convenience. Once the unit 450 is moved to an opposite side of the paver 50, the downwardly turned flange 461 (FIG. 19) on top of the control unit 450 may be quickly placed over a frame rail 120 or 120B (FIG. 4) for securing the ladder 451 and foot stool 452 during subsequent operation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concrete finishing machine for rail track bed construction, the machine comprising:

an elongated, horizontally extending frame adapted to be deployed above the track bed;

a plurality of vertically upright jack stands for supporting the frame, the jack stands supported by wheeled bogies adapted to rest upon and move over suitable supports provided at opposite sides of the track bed;

a slidable carriage that is displaceable relative to the frame, the carriage comprising wheels for engaging the frame; and, a plurality of downwardly extending, longitudinally displaceable paving heads suspended from said carriage for engaging and finishing wet concrete below, each paving head comprising a tool for forming channels in the concrete, and wherein adjacent paving heads are slidably positioned apart to form plinth strips between said channels.

2. The machine as defined in claim 1 wherein said tool for forming channels comprises a strike off adapted to contact and shape wet concrete.

3. The machine as defined in claim 2 wherein the jack-stands are angularly pivotable relative to said frame.

4. The machine as defined in claim 2 further comprising rollers enabling the frame to slide relative to the jack-stands.

5. The machine as defined in claim 1 wherein the paving heads are slidable relative to the carriage, and suspended by head wheels that engage the carriage for enabling longitudinal position adjustments of the heads relative to said carriage.

6. The machine as defined in claim 5 wherein the frame comprises a plurality of frame segments adapted to be coupled together.

7. The machine as defined in claim 6 wherein the frame has a plurality of corners and one of the plurality of jack stands is positioned at each corner.

8. A concrete finishing machine for rail track bed construction, the machine comprising:

an elongated, horizontally extending frame adapted to be deployed above a track bed;

a plurality of vertically upright jack stands for supporting the frame, the jack stands supported by wheeled bogies adapted to rest upon and move over suitable supports provided at opposite sides of the track bed;

a slidable carriage that is suspended within said frame and displaceable relative thereto; and, a plurality of downwardly extending, longitudinally displaceable paving heads suspended from said carriage for engaging and finishing wet concrete below, each paving head comprising a lower strike-off for forming channels in the concrete, and wherein adjacent paving heads are slidably positioned apart to form parallel plinth strips between selected adjacent channels.

9. The machine as defined in claim 8 wherein the frame comprises a plurality of frame segments adapted to be coupled together.

10. The machine as defined in claim 9 wherein the frame has a plurality of corners and one of the plurality of jack stands is positioned at each corner, and wherein each jack stand is variable in length to enable changes in carriage elevation.

11. The machine as defined in claim 8 further comprising a swing-out assembly for enabling radial displacements of each jack stand relative to the frame.

12. The machine as defined in claim 10 wherein the paving heads are adjustable in length and wherein each jack stand is variable in length to enable machine elevation changes.

13. The machine as defined in claim 12 wherein at least one wheeled bogie is driven hydraulically.

14. A concrete finishing machine for rail track bed construction, the machine comprising:

an elongated, horizontally extending frame adapted to be deployed above the track bed, the frame comprising at least one frame segment;

a plurality of vertically upright jack stands for supporting the frame, the jack stands supported by wheeled bogies adapted to rest upon and move over suitable supports provided at opposite sides of the track bed, the jack stands adjustable in length;

rollers for enabling the frame to slide relative to the jack-stands;

a slidable carriage that is slidably displaceable within the frame, the carriage comprising wheels for engaging the frame;

a plurality of downwardly extending, longitudinally displaceable paving heads suspended from said carriage for engaging and finishing wet concrete below, each paving head comprising a strike off adapted to contact wet concrete for forming channels, and wherein adjacent paving heads are slidable relative to the carriage and slidably positioned apart to form plinth strips between said channels; and, wherein the paving heads are suspended by head wheels that engage the carriage for enabling longitudinal adjustments of the heads relative to the carriage.

15. The machine as defined in claim 14 wherein the jack-stands are angularly pivotable relative to said frame.

16. The machine as defined in claim 15 further comprising a swing-out assembly for enabling radial displacements of at least one jack stand relative to the frame.

17. The machine as defined in claim 14 wherein the paving heads are adjustable in length to change elevation.

18. The machine as defined in claim 14 wherein at least one wheeled bogie is hydraulically driven.

* * * * *